US006484552B1

(12) United States Patent
Bernas et al.

(10) Patent No.: US 6,484,552 B1
(45) Date of Patent: Nov. 26, 2002

(54) HINGED DIE CAGE ASSEMBLY

(75) Inventors: James M. Bernas; Gary R. Lisenbee, both of Maumee; Christopher R. Nusbaum, Holland, all of OH (US)

(73) Assignee: Eaton Aeroquip, Inc., Maumee, OH (US)

( * ) Notice: Subject to any disclaimer, the term of this patent is extended or adjusted under 35 U.S.C. 154(b) by 0 days.

(21) Appl. No.: 09/738,603

(22) Filed: Dec. 16, 2000

(51) Int. Cl.[7] ..... B21D 39/04
(52) U.S. Cl. ..... 72/402; 29/237
(58) Field of Search ..... 72/402, 416, 412; 29/237, 282

(56) References Cited

U.S. PATENT DOCUMENTS

| | | | | |
|---|---|---|---|---|
| 1,322,584 A | * | 11/1919 | Kraft | |
| 1,818,435 A | * | 8/1931 | Smith | |
| 1,890,016 A | * | 12/1932 | Smith | |
| 2,182,663 A | * | 12/1939 | Eby | |
| 3,851,514 A | | 12/1974 | Chen et al. | 72/402 |
| 4,034,592 A | | 7/1977 | Chen et al. | 72/402 |
| 4,527,414 A | | 7/1985 | Jurkovic et al. | 72/402 |
| 4,989,443 A | * | 2/1991 | Sawdon | 72/402 |
| 5,353,623 A | * | 10/1994 | Bobenhausen | 72/402 |
| 5,644,945 A | | 7/1997 | Baldwin et al. | 72/402 |

FOREIGN PATENT DOCUMENTS

| | | | | |
|---|---|---|---|---|
| DE | 19842765 A1 | | 9/1998 | |
| DE | 19958103 C1 | | 12/1999 | |
| JP | 57-109536 | * | 7/1982 | 72/402 |
| WO | WO 02/47840 A2 | | 12/2001 | |

OTHER PUBLICATIONS

Derwent English Abstracts fo DE19958103C1 and DE19842765A1.
International Search Report, 3 pages.

* cited by examiner

*Primary Examiner*—Daniel C. Crane
(74) *Attorney, Agent, or Firm*—Rader, Fishman & Grauer PLLC

(57) ABSTRACT

A crimping apparatus for receiving a circular array of die segments for radially inwardly crimping an end fitting onto a hose includes an upper plate assembly and a lower plate assembly. The upper plate assembly includes an upper back plate attached to an upper front plate by a plurality of fasteners. The lower plate assembly includes a lower back plate attached to a lower front plate by a plurality of fasteners. The upper back plate and lower back plate cooperate to form a first hinge portion and the upper front plate cooperates with the lower front plate to form a second hinge portion. The arrangement allows the upper assembly to pivot about the lower assembly at the first and second hinge portions. The crimping apparatus is advantageous because it allows the passage of large elbow hose fittings that could not pass through the central bore of a conventional die cage.

17 Claims, 6 Drawing Sheets

HINGED DIE CAGE ASSEMBLY

FIELD OF THE INVENTION

This invention relates to crimping machines for radially crimping or contracting the socket of a hose fitting onto the end of a hose and more particularly to a crimping die assembly for use in such crimping machines.

BACKGROUND OF THE INVENTION

In the production of hose assemblies, it is common to permanently secure a hose fitting onto the end of a hose by deforming or crimping an outer socket of the fitting around the hose end to compress the hose end between the socket and a fitting nipple positioned inside the hose bore. To accomplish the crimping, it is a common practice to utilize a circular array of pie-shaped die segments to physically engage the fitting socket and reduce the socket in diameter, thereby securing the fitting to the hose end.

In the art of hose crimping, a common practice is to utilize a rigid die cage assembly to fix the die segments in a circular array. A die cage assembly is advantageous because it aligns the die segments for proper interaction with a die plate and facilitates ease of use by allowing the crimp machine operator to handle one assembly instead of several individual die segments. A conventional die cage assembly provides a further advantage of maintaining the die segments in a spaced apart position prior to the crimping operation to allow insertion of a hose fitting into a central axial bore between the die segments. The insertion is typically accomplished by incorporating a spring positioned between the die cage and the die segments, which is used to force the segments radially outward to enlarge the central bore.

Conventional crimping machines typically employ an engagement mechanism for receiving a die cage assembly. Once received within the crimping machine, the central bore of the die segments may be reduced by actuating a hydraulic ram to drive the die cage assembly into a die plate. The die segments typically have a radially outer conical cam surface that engages a frusto-conical bore of the die plate as the die cage assembly is driven into the die plate. The engagement of the die plate and the die segments converts the axial movement of the die cage assembly into radial contraction of the die segments by the camming action of the conical outer surface of the die segments against the bore of the die plate. The camming affect reduces the central bore of the die segments, thereby engaging and reducing the diameter of the fitting socket and securing the fitting to the hose end.

A further advantage of a die cage assembly is that it allows the crimp machine operator to easily interchange assemblies. The die cage assembly can be readily removed from the engagement mechanism on a crimping machine and replaced with another assembly containing a different array of die segments. Therefore, one crimp machine may be employed to crimp several different hose and fitting combinations over a broad range of diameters.

While the use of a die cage assembly offers several advantages, such as ease of handling and interchangeability, it also has undesirable limitations. One key limitation is that only fittings that have a terminal end capable of passing through the relatively small central bore between the die segments may be crimped in a conventional die cage assembly. Thus, such a limitation prevents a fitting having a terminal end in the shape of a large elbow from passing through the central bore of the die segments.

SUMMARY OF THE INVENTION

The present invention is directed to a hinged die cage assembly that allows an upper plate assembly to pivot about a lower plate assembly. When the upper plate assembly is pivoted to an "open" position, large elbow hose fittings are permitted to pass through the central bore of the die segments.

In accordance with an embodiment of the present invention, a die cage assembly is provided that includes an upper plate assembly and a lower plate assembly. The upper plate assembly includes an upper back plate attached to an upper front plate by a first plurality of fasteners. The lower plate assembly includes a lower back plate attached to a lower front plate by a second plurality of fasteners. The upper back plate and lower back plate cooperate to form a first hinge portion and the upper front plate cooperates with the lower front plate to form a second hinge portion. The first hinge portion and second hinge portion are joined such that the upper plate assembly is able to pivot about the lower plate assembly at the first and second hinge portions. The upper and lower plate assemblies are adapted to receive a plurality of die segments for radially inwardly crimping a fitting onto an end of a hose.

The present invention is advantageous because it allows passage of large elbow hose fittings that would not pass through the central bore of the die segments in a conventional die cage. The invention is further advantageous because it achieves the aforementioned result without destroying the integrity of a conventional die cage assembly.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
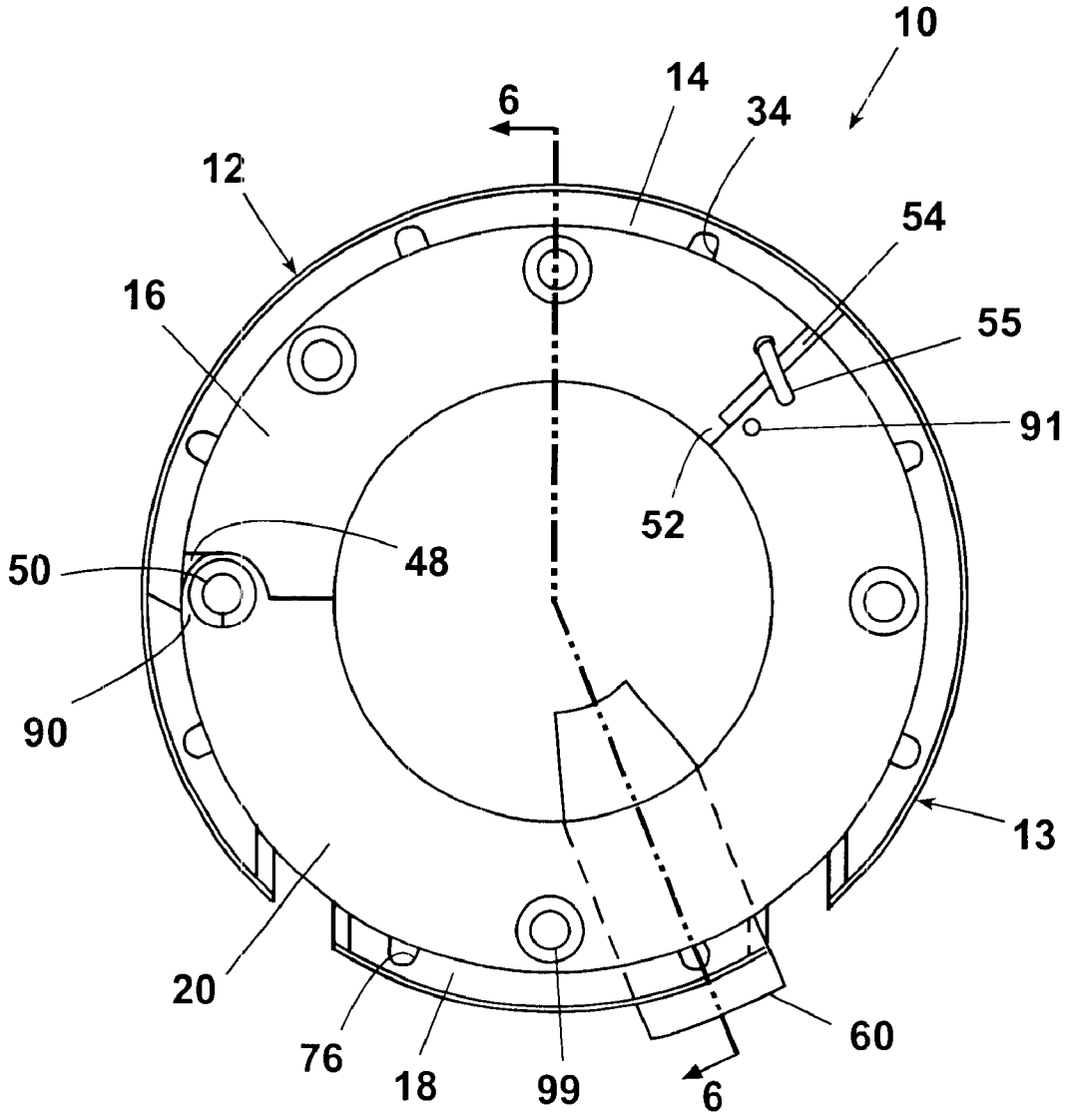
FIG. 1 is a view of a die cage assembly according to the present invention.

Referring now to the drawings, FIG. 1 is a view of a die cage assembly 10 according to the present invention. Die cage assembly 10 is intended for use in a conventional crimping machine for radially crimping the collar of a hose fitting onto the end of a hose. Conventional crimping machines are well known in the art and, therefore, are not shown in the drawings and will only be described in limited detail below. Conventional crimping machines typically have a die plate with a frusto-conical through bore adapted to engage a plurality of crimping dies each having a radially outer conical surface. The conventional die cage assembly typically includes a plurality of pie-shaped die segments arranged in a circular array around a central axial bore. The individual die segments are spaced apart from each other when not engaging the die plate so as to permit a hose fitting that is to be crimped to be placed in the central bore. Typically, a hydraulic ram in the crimping machine is used to force the die cage assembly into the frusto-conical bore of the die plate. The axial movement of the die cage assembly is converted into radial contraction of the die segments by the camming action of the frusto-conical bore of the die plate on the radially outer conical surfaces of the die segments. Thus, the die segments are compressed radially so as to reduce the diameter of the central bore, thereby causing the radially inner surfaces of the die segments forming the central bore to cold work the socket material of the hose fitting and radially reduce its size. Those skilled in the art will also appreciate that hose fittings adapted for crimping onto the end of a hose are also conventional and well known and are likewise not shown in the drawings.

Die cage assembly 10 shown and describe herein may be modified as needed to be received in the known variations of conventional crimping machines without departing from or limiting the scope of the present invention. With this in mind, die cage assembly 10 includes an upper plate assembly 12 and a lower plate assembly 13. Upper plate assembly 12 includes an upper back plate 14 and an upper front plate 16. Lower plate assembly 13 includes a lower back plate 18 and a lower front plate 20.

Figure 2:
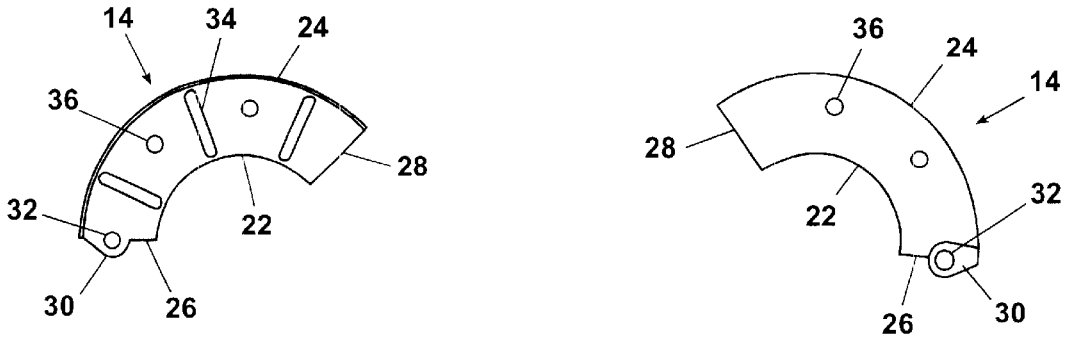
FIG. 2 is a front and back view of the upper back plate of the die cage assembly.

Referring to FIG. 2, upper back plate 14 includes an inner radial surface 22 and an outer radial surface 24. Inner surface 22 and outer surface 24 cooperate with a first end portion 26 and a second end portion 28 to define the arc geometry of upper back plate 14. First end portion 26 includes a hinge portion 30 having an aperture 32 therethrough. Upper back plate 14 further includes a plurality of grooves 34 extending radially outwardly of inner surface 22. A plurality of internally threaded apertures 36 are positioned substantially between adjacent grooves 34 and are each designed to receive a threaded end 37 of a fastener 38, such as a bolt.

Figure 3:
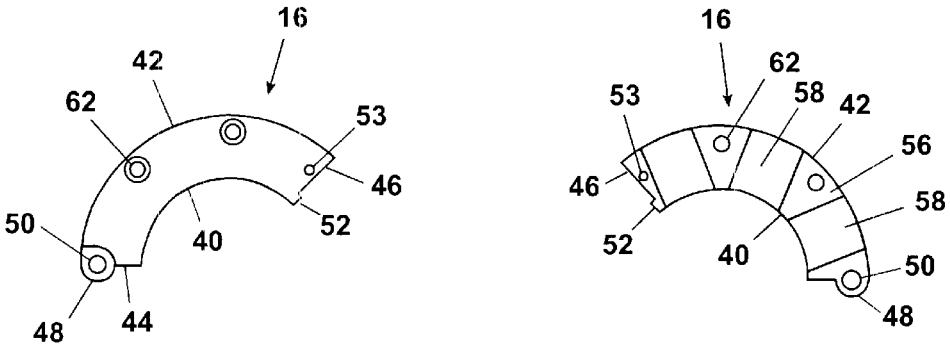
FIG. 3 is a front and back view of the upper front plate of the die cage assembly.

Referring to FIG. 3, upper front plate 16 includes an inner radial surface 40 and an outer radial surface 42. Inner surface 40 and outer surface 42 cooperate with a first end 44 and a second end 46 to define upper front plate 16 as an arc of substantially the same degree as upper back plate 14. First end 44 includes a hinge portion 48 having an aperture 50 therethrough. Second end 46 of upper front plate 16 includes a protrusion 52 designed to cooperate with lower front plate 20 to form a void 54 (as best Seen in FIG. 1). Second end 46 further includes at least one aperture 53 therethrough for receiving a latching member 55 (as seen in FIG. 1) to secure upper plate assembly 12 to lower plate assembly 13 when latching member 55 is engaged. Void 54 provides clearance for latching member 55 in case latching member 55 is inadvertently not engaged in a "parked" position, as will be described in further detail below. Upper front plate 16 further includes a rear face 56 having a plurality of slots 58. Slots 58 have a generally rectangular cross-section. In addition, upper front plate 16 includes a plurality of apertures 62 therethrough that are positioned substantially between adjacent slots 58. Apertures 62 are each designed to allow passage of fasteners 38 for securing upper front plate 16 to upper back plate 14.

Figure 4:
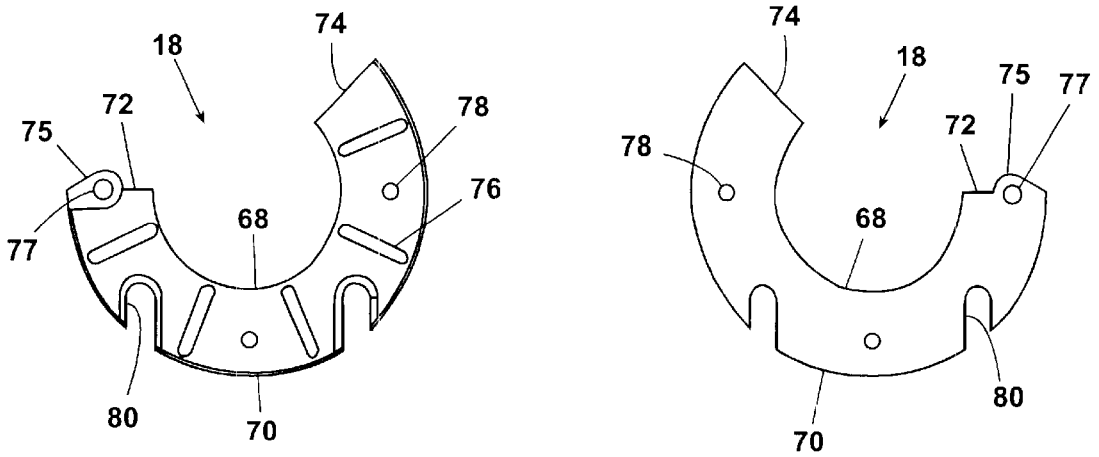
FIG. 4 is a front and back view of the lower back plate of the die cage assembly.

Referring to FIG. 4, lower back plate 18 includes an inner radial surface 68 and an outer radial surface 70, each substantially equal in radius to inner surface 22 and outer surface 24, respectively, in upper back plate 14. Inner surface 68 and outer surface 70 cooperate with a first end 72 and a second end 74 to define the arc geometry of lower back plate 18. First end 72 includes a hinge portion 75 having an internally threaded aperture 77 therethrough. Lower back plate 18 further includes a plurality of radially extending grooves 76 and a plurality of threaded apertures 78, each of which are substantially similar to grooves 34 and threaded apertures 36 in upper back plate 14. Lower back plate 18 further includes at least two retaining slots 80 for engaging retaining members (not illustrated) on a crimping machine and substantially retaining die cage assembly 10 on a crimping machine.

Figure 5:
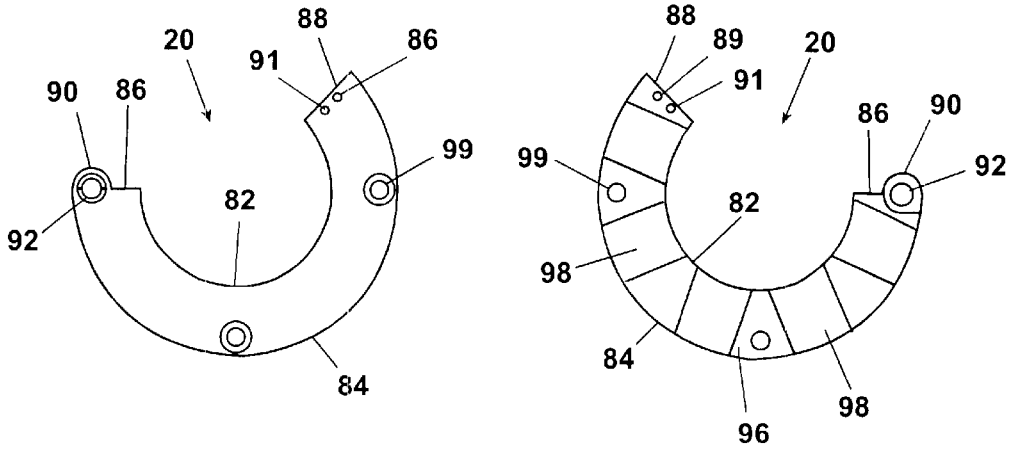
FIG. 5 is a front and back view of the lower front plate of the die cage assembly.

Referring to FIG. 5, lower front plate 20 includes an inner radial surface 82 and an outer radial surface 84, each substantially equal in radius to inner surface 40 and outer surface 42 respectively in upper front plate 16. Surfaces 82 and 84 cooperate with a first end 86 and a second end 88 to define lower front plate 20 as an arc of substantially the same degree as lower back plate 18. First end 86 includes a hinge portion 90 having an aperture 92 therethrough. Second end 88 includes a first aperture 89, therethrough for receiving latching member 55 to secure upper plate assembly 12 to lower plate assembly 13 when latching member 55 is engaged. Second end 88 further includes a second aperture 91 therethrough for receiving latching member 55 when not being used to secure upper plate assembly 12, such as when die cage assembly 10 is being used in a crimp machine. Latching member 55 is considered to be in the "parked" position when engaged in apertures 89 and 91. As described above, void 54 provides clearance for latching member 55 in case latching member 55 is inadvertently not engaged in the "parked" position. The extra clearance reduces the possibility of damage to an "open" die cage assembly engaging a die plate. Lower front plate 20 further includes a rear face 96 containing a plurality of slots 98 and a plurality of apertures 99, each substantially similar to slots 58 and apertures 62 in upper front plate 16.

Figure 6:
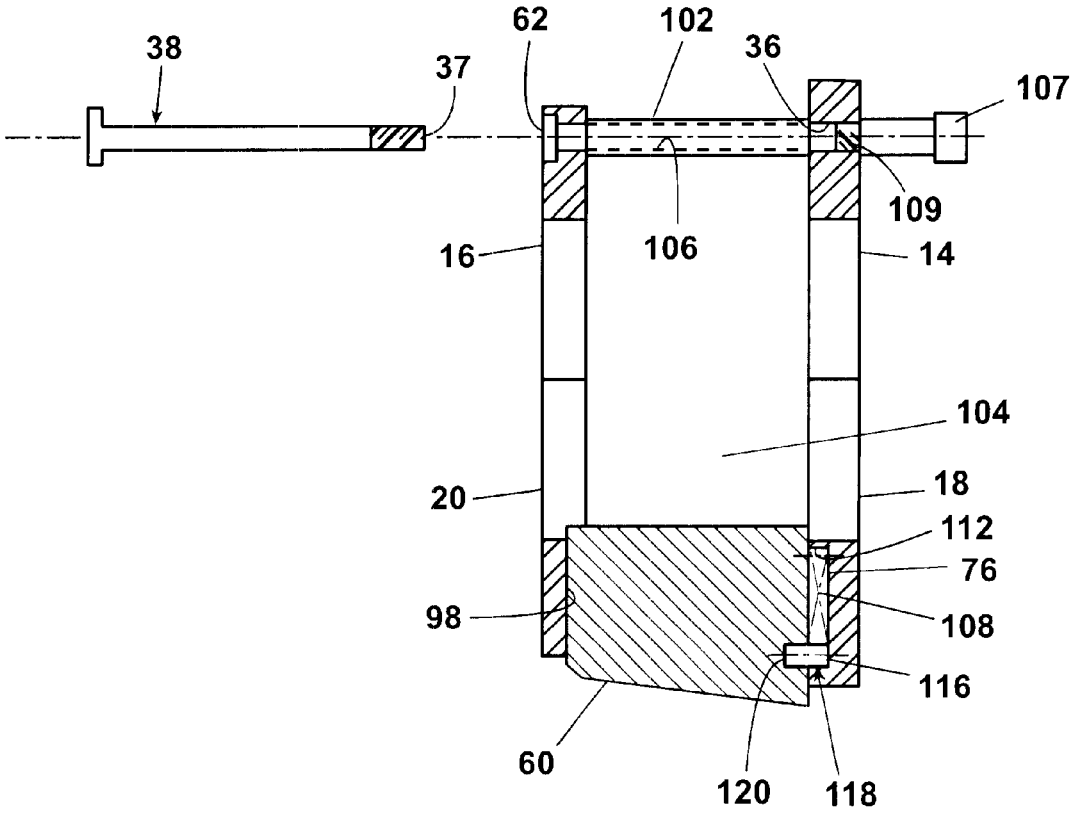
FIG. 6 is a cross sectional view along the plane indicated by 6—6 in FIG. 1.

Referring to FIG. 6, upper back plate 14 is separated from upper front plate 16 and lower back plate 18 is separated from lower front plate 20 by a plurality of spacers 102. Spacers 102 cooperate with front plates 16 and 20 and back plates 14 and 18 to define an interior 104 for receiving a plurality of die segments 60 (best seen in FIG. 7). Die segments 60 are retained in interior 104 circumferentially by slots 98 and radially by grooves 76 in lower plate assembly 13, as seen in FIG. 6, and by slots 58 and grooves 34 in upper plate assembly 12 (not illustrated).

Back plates 14 and 18 are fixedly attached to front plates 16 and 20 by fasteners 38. Fasteners 38 pass through apertures 62 and 99 in front plates 16 and 20, through a duct 106 in spacers 102, and engage threaded apertures 36 and 78 in back plates 14 and 18. Preferably, one of fasteners 38, namely a fastener 38*a*, may be shorter in length such that threaded end 37 only engages one-half the entire depth of one of apertures 36. A hanging member 107 having a threaded end 109 engages one-half the entire depth of the same threaded aperture 36 as fastener 38*a*, except on the opposite side. Hanging member 107 assists in supporting die cage assembly 10 on a crimping machine. Alternately, fastener 38*a* may be longer in length such that threaded end 37 protrudes out of one of threaded apertures 36. Hanging member 107 may alternately include a threaded duct (not illustrated) that is threaded onto the protruding threaded end 37 of fastener 38*a*.

As seen in FIG. 6, grooves 34 and 76 receive a compressible member 108, such as a spring. Compressible member 108 is retained against an inner end 112 of grooves 34 and 76 and against a first end 116 of a cylindrical member 118, such as a roll pin. A second end 120 of cylindrical member 118 engages die segments 60. The compressive force of compressible member 108 acts against cylindrical member 118, thereby forcing die segments 60 radially outwardly to enlarge a central axial bore 122 between die segments 60 (as best seen in FIG. 7).

Figure 7:
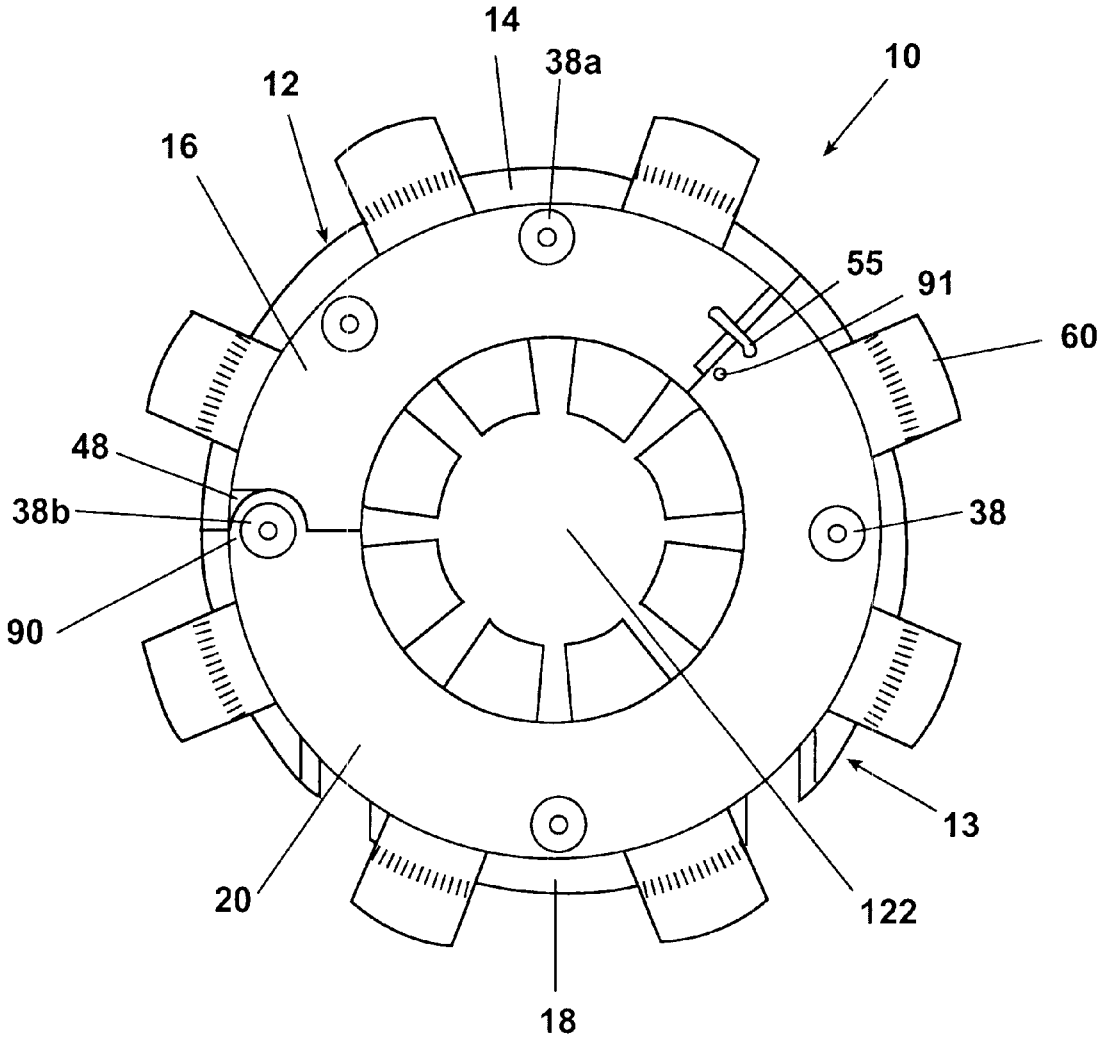
FIG. 7 is a view of the die cage assembly in the "closed" position having received a plurality of die segments.

Referring to FIG. 7, hinge portion 48 in upper front plate 16 cooperates with hinge portion 90 in lower front plate 20 to align apertures 50 and 92. Similarly, hinge portion 30 in upper back plate 14 cooperates with hinge portion 75 in lower back plate 18, thereby aligning apertures 32 and 77 (not illustrated). This alignment permits a fastener 38, namely 38*b*, to pass first through aligned apertures 50 and 92 and second through aperture 32 thereby engaging internally threaded aperture 77. Threaded end 37 of fastener 38*b* rotatably engages internally threaded aperture 77 to fixedly attach upper plate assembly 12 to lower plate assembly 13.

Figure 8:
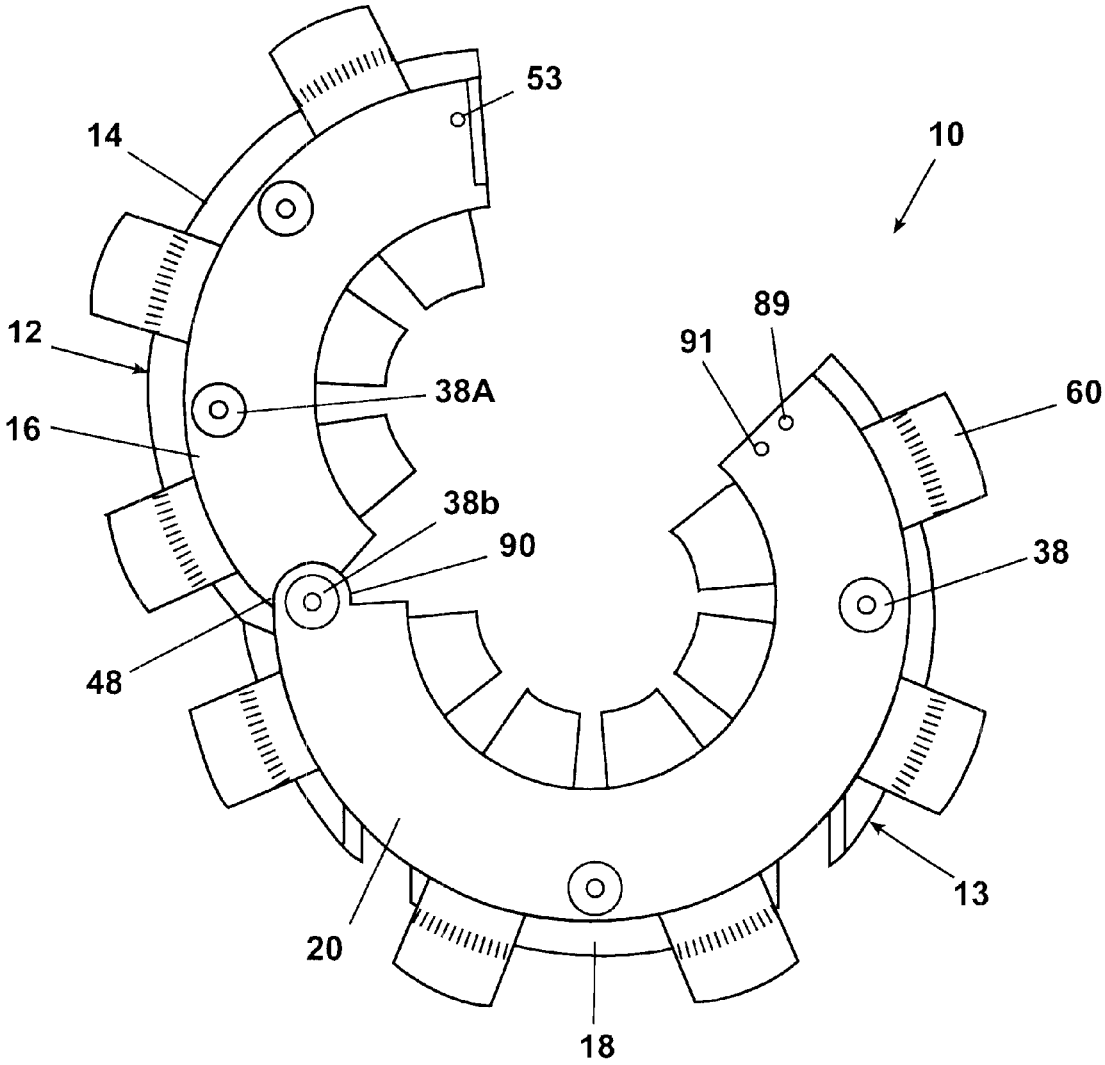
FIG. 8 is a view of the die cage assembly of FIG. 7 in the "open" position.

Referring to FIG. 8, die cage assembly 10 is shown in the "open" position as opposed to the "closed" position as depicted in FIG. 7. When latch member 55 is removed, upper plate assembly 12 is free to pivot about lower plate assembly 13 at the interface of hinge portions 30 and 75 and hinge portions 48 and 90. When upper plate assembly 12 is pivoted to an "open" position, large elbow hose fittings are permitted to pass through central bore 120 of die segments 60.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A crimping apparatus for receiving a plurality of die segments for radially inwardly crimping an end fitting onto a hose, comprising:

a lower back plate member and an lower front plate member, each plate member having a hinge portion and each hinge portion cooperating to form a first hinge portion;

an upper back plate member and an upper front plate member, each plate member having a hinge portion and each hinge portion cooperating to form a second hinge portion;

said lower back plate and said lower front plate are fixedly attached to form a lower plate assembly, said upper back plate and said upper front plate are fixedly attached to form an upper plate assembly; and wherein said lower plate assembly and said upper plate assembly are connected at said first and second hinge portions such that said upper plate assembly may pivot about said lower plate assembly at said first and second hinge portions.

2. The apparatus according to claim 1, wherein said lower front plate and said upper front plate include a plurality of slots.

3. The apparatus according to claim 1, wherein at least two spacer members are positioned between said lower back plate and said lower front plate in said lower plate assembly and between said upper back plate and said upper front plate in said upper plate assembly, such that the die segments are received between the spacer members in a single plate assembly.

4. The apparatus according to claim 3, wherein each spacer member includes a duct therethrough.

5. The apparatus according to claim 1, further including a latch member for securing said lower plate assembly to said upper plate assembly.

6. The apparatus according to claim 1, wherein said lower back plate and said lower front plate are fixedly attached by at least one first fastener to form said lower plate assembly and said upper back plate and said upper front plate are fixedly attached by at least one second fastener to form said upper plate assembly.

7. The apparatus according to claim 6, wherein said lower plate assembly and said upper plate assembly are connected by a third fastener that extends through said first and second hinge portions.

8. The apparatus according to claim 5, wherein said upper front plate and said lower front plate cooperate to form a void to provide clearance for said latch member in case said latch member is inadvertently not engaged in a parked position.

9. A crimping apparatus for receiving a plurality of die segments for radially inwardly crimping an end fitting onto a hose, comprising:

a lower back plate member and an lower front plate member, each plate member having a hinge portion and each hinge portion cooperating to form a first hinge portion;

an upper back plate member and an upper front plate member, each plate member having a hinge portion and each hinge portion cooperating to form a second hinge portion;

said lower back plate and said lower front plate are fixedly attached by at least one first fastener to form a lower plate assembly, said upper back plate and said upper front plate are fixedly attached by at least one second fastener to form an upper plate assembly;

at least one spacer member positioned between said lower back plate and said lower front plate in said lower plate assembly and between said upper back plate and said upper front plate in said upper plate assembly; and wherein said lower plate assembly and said upper plate assembly are connected by a fastener at said first and second hinge portions such that said upper plate assembly may pivot about said lower plate assembly at said first and second hinge portions.

10. The apparatus according to claim 9, wherein said lower back plate and said upper back plate include a plurality of grooves.

11. The apparatus according to claim 10, wherein a compressible member is received in said grooves, said compressible member acting to bias the die segments radially outwardly.

12. The apparatus according to claim 9, wherein said lower front plate and said upper front plate include a plurality of slots.

13. The apparatus according to claim 9, wherein said spacer members are positioned such that said fasteners are allowed to pass through a duct in said spacer members.

14. The apparatus according to claim 9, further including a latch member for securing said lower assembly to said upper assembly.

15. The apparatus according to claim 14, wherein said upper front plate and said lower front plate cooperate to form a void to provide clearance for said latch member in case said latch member is inadvertently not engaged in a parked position.

16. A crimping apparatus for receiving a plurality of die segments for radially inwardly crimping an end fitting onto a hose, comprising:

a lower back plate member and an lower front plate member, each plate member having a hinge portion and each hinge portion cooperating to form a first hinge portion;

an upper back plate member and an upper front plate member, each plate member having a hinge portion and each hinge portion cooperating to form a second hinge portion;

said lower back plate and said upper back plate include a plurality of grooves, wherein a compressible member is received in said grooves, said compressible member acting to bias the die segments radially outwardly;

said lower back plate and said lower front plate are fixedly attached by at least one first fastener to form a lower plate assembly, said upper back plate and said upper front plate are fixedly attached by at least one second fastener to form an upper plate assembly;

at least one spacer member positioned between said lower back plate and said lower front plate in said lower plate assembly and between said upper back plate and said upper front plate in said upper plate assembly; and wherein said lower plate assembly and said upper plate assembly are connected by a fastener at said first and second hinge portions such that said upper plate assembly may pivot about said lower plate assembly at said first and second hinge portions; and a latch member for securing said lower assembly to said upper assembly.

17. A crimping apparatus for receiving a plurality of die segments for radially inwardly crimping an end fitting onto a hose, comprising:

a lower back plate and an lower front plate, each plate member having a hinge portion and each hinge portion cooperating to form a first hinge portion;

an upper back plate and an upper front plate, each plate member having a hinge portion and each hinge portion cooperating to form a second hinge portion;

said lower back plate and said lower front plate are fixedly attached to form a lower plate assembly, said upper back plate and said upper front plate are fixedly attached to form an upper plate assembly;

wherein said lower plate assembly and said upper plate assembly are connected at said first and second hinge portions such that said upper plate assembly may pivot about said lower plate assembly at said first and second hinge portions; and wherein said lower plate assembly and said upper plate assembly include at least one groove for each of the die segments, said groove including a compressible member that acts to bias the die segments radially outwardly.

* * * * *